US007465907B1

(12) United States Patent
Martino et al.

(10) Patent No.: US 7,465,907 B1
(45) Date of Patent: Dec. 16, 2008

(54) MICROWAVE BOILER AND HOT WATER HEATER

(76) Inventors: Raymond Martino, 9 Chincopee Ave., Hopatcong, NJ (US) 07843; William Percy, 78 Indian Trail, Andover, NJ (US) 07821

( * ) Notice: Subject to any disclaimer, the term of this patent is extended or adjusted under 35 U.S.C. 154(b) by 0 days.

(21) Appl. No.: 11/889,374

(22) Filed: Aug. 13, 2007

(51) Int. Cl.
*H05B 6/80* (2006.01)

(52) U.S. Cl. ..... 219/688; 219/756; 219/759; 392/320

(58) Field of Classification Search ..... 219/687–690, 219/756, 759; 392/314, 320, 324, 339–342
See application file for complete search history.

(56) References Cited

U.S. PATENT DOCUMENTS 3,812,315 A 5/1974 Martin
3,891,817 A 6/1975 Brown
4,114,011 A 9/1978 Stubbs
4,152,567 A 5/1979 Mayfield
4,310,738 A 1/1982 Moretti et al.
4,358,652 A 11/1982 Kaarup
5,247,148 A 9/1993 Mencher
5,387,780 A 2/1995 Riley
6,064,047 A 5/2000 Izzo
2002/0011487 A1 1/2002 Matsuo et al.
2004/0149742 A1 * 8/2004 Lescano ..... 219/688
2005/0139594 A1 6/2005 Jones et al.

* cited by examiner

*Primary Examiner*—Philip H Leung
(74) *Attorney, Agent, or Firm*—Thomas J. Germinario

(57) ABSTRACT

A microwave water heater, which utilizes a triple plenum design with bi-planar cross-flow to provide uniformly heated water for both baseboard room heating and hot tap water, is adaptable to existing heating/plumbing systems and is readily expandable.

6 Claims, 4 Drawing Sheets

MICROWAVE BOILER AND HOT WATER HEATER

BACKGROUND OF THE INVENTION

This invention relates to a combination boiler and hot water heater which utilizes microwave energy to heat the water.

Conventional boilers and hot water heaters use either a combustible material or electricity as a source of heat. Combustibles derived from fossil fuels, such as natural gas, oil and propane, have numerous disadvantages, some of which are broad and some of which are specific to water heating applications. The broad disadvantages of combustion-based water heating systems include the limited and diminishing supply of fossil fuels, fuel price volatility, and emissions that contribute to air pollution and global climate change. In water heating applications, combustion-based systems involve risks of fuel leakage, explosion, fire, and contamination of the living space with dust and flue gas. Combustion-based systems are also expensive to purchase and install, occupy a lot of space, and require massive chimney structures to vent emissions. Moreover, such systems are characterized by low efficiencies and substantial heat losses.

Conventional electric boilers and hot water heaters, on the other hand, have their own set of problems. Generation of heat by an electrical resistive element is expensive, slow and inefficient. Electrical resistive elements used to heat water are subject to fouling with mineral deposits that limits their efficiency and their useful life and leads to high maintenance expenses.

In response to the deficiencies of conventional electrical and combustion-based systems, a number of microwave water heating systems have been developed and are described in the prior art. There are a number of generic advantages of such microwave-based systems as compared to their conventional counterparts. Microwave heating of fluids is rapid and efficient, thus addressing the need for energy conservation. There are no associated emissions and no need for elaborate and expensive ventilation equipment and chimney structures. Microwave boilers are relatively compact, inexpensive and easy to install. They are safe, involving minimal risks with respect to fire, explosion and leakage. They also require relatively little maintenance.

All of that being said, there still remain a number of problems associated with the application of microwave technology to conventional space heating and hot water systems. The fact that these problems have not been satisfactorily resolved by the prior art is demonstrated by the virtual absence of microwave boilers and water heaters in the marketplace. One of the problems with the prior art microwave systems is that they are not easily integrated with typical existing plumbing and heating systems.

The prior art systems also tend to be overly specialized. Some of these systems are designed to quickly provide hot tap water on demand, but are incapable of supplying large volumes of hot water, as would be needed to provide baseboard room heating. Other systems that do provide substantial boiler capacity are less efficient and responsive with respect to immediate hot tap water demands. Therefore, the prior art does not disclose a microwave domestic water heating system that effectively combines the functions of a boiler, to provide continuous baseboard room heat, and a hot water heater, to respond quickly when a hot water faucet is opened.

In terms of their structure, the prior art microwave hot water systems can be broadly classified as two types. The first type is a single plenum or "wet wall" design, in which the microwave source is mounted on a wall that is in direct contact with the water. In the single plenum design, the heater/boiler has only one interior space through which water flows. In some versions of the single plenum design, such as Brown, U.S. Pat. No. 3,891,817, the plenum comprises a tank of heated water, as in a conventional boiler. This type of system is adaptable to a hydronic space heating system, but is not well suited to supplying hot tap water. Other single plenum systems, such as Mayfield, U.S. Pat. No. 4,152,567, and Mencher, U.S. Pat. No. 5,247,148, have a low-volume cavity in which water is rapidly heated to supply hot tap water on demand. But these systems lack the storage capacity to provide hot water baseboard heat.

One of the problems with single plenum designs is uneven heating, causing liquid temperature gradients which reduce efficiency. The Mencher design attempts to overcome this problem by extending microwave dielectric plates across the entire length of the fluid flow chamber, but this has the disadvantage of limiting the size of the chamber and hence the volume of fluid heated. Another single plenum design, Moretti et al., U.S. Pat. No. 4,310,738, seeks to achieve uniform heating by using a microwave diffuser in combination with a network of upright metal baffle walls, which divide the plenum into a circuitous flow path. But in the Moretti design, the motor-driven diffuser consumes energy, making the overall system less efficient. Another drawback arises insofar as the upright baffle walls are imbedded in the plastic window through which the microwaves pass into the liquid plenum. The embedded metal in the microwave window gives rise to points of microwave reflection, in addition to problems associated with the metal-to-plastic seal, including potential leakage of microwaves, heat and water.

The latter problem of the Moretti design is one shared to some degree by all of the single plenum or "wet wall" systems. In these systems, the microwave source is directly coupled to the water-bearing plenum through a translucent microwave-permeable window, which protects the microwave source from water and steam that would damage its electrical components. The inherent weakness of the seams between this window and the metal wall enclosing the remainder of the plenum is a limiting factor on the temperature and pressure at which the system may safely operate. The limited integrity of the metal-to-glass or metal-to-plastic seal around the window also involves safety hazards with respect to microwave leakage and is a source of maintenance problems.

The problems associated with the single plenum or "wet wall" design have led microwave water heaters to evolve in the direction of dual plenum systems. In these systems, the heated water flows within a plenum which is enclosed inside a larger interior space to which the microwave source is coupled. Thus, the microwave source is coupled to a "dry wall" rather than a "wet wall", thereby foregoing the need for a translucent window to protect the microwave source and eliminating the seam/seal problems associated with that window. In effect, therefore, there is a "wet" inner plenum, through which the heated water flows, and a "dry" outer plenum, to which the microwave source is coupled.

In most dual plenum systems, the "wet" inner plenum consists of pipe or tubing, typically having a helical or coiled configuration. Dual plenum systems of this type are disclosed in Martin, U.S. Pat. No. 3,812,315, Kaarup, U.S. Pat. No. 4,358,652, Matsuo et al., Pub. No. US 2002/0011487, and Jones et al., Pub. No. US 2005/0139594. Achieving uniform heating is, however, problematic in these systems. While the Martin system seeks to achieve uniform heating through a complex matrix of multiple dielectric plates and switches for applying sequential radiation to different areas of the coiled tubing, the overall system is large, cumbersome and expensive, with many potential breakdown points. Moreover, these dual plenum systems are all designed to deliver hot water on demand, and are not adaptable to supplying hot water baseboard heat.

Another version of the dual plenum design is disclosed in Stubbs, U.S. Pat. No. 4,114,001, in which the "wet" inner plenum comprises a parabolic array of microwave absorbent structures. In one embodiment of the Stubbs system (FIGS. 2 and 3), coiled piping serves as the inner plenum, similar to the Martin design, except for the parabolic configuration. In another embodiment of the Stubbs invention (FIGS. 5 and 6), the coiled piping is enclosed in a solid parabolic panel having multiple pyramid-shaped projections. In both cases, the heated liquid in the inner plenum is totally dedicated to a continuous flow through a system of heater exchangers or radiators for room heating (FIG. 1).

A comparison of the Stubbs and Martin patents points out a common deficiency in the dual plenum designs. Having segregated the heated water in an inner plenum tube or pipe, one can choose to use it either as a source of hot tap water or for room heating, but not for both at the same time. Another version of the dual plenum design attempts to overcome this limitation by using a chamber rather than a tube/pipe as the "wet" inner plenum, as disclosed in Riley, U.S. Pat. No. 5,387,780. In one embodiment of the Riley invention (FIG. 5), a once-through microwave-permeable coil can be inserted into the chamber/tank to provide hot tap water. But, since no mechanism in disclosed in Riley for circulating the water in the chamber around the coil to achieve even heat distribution, its ability to supply hot tap water at a constant uniform temperature is questionable.

It follows that the next logical step in the evolution of the microwave water heating systems will involve a triple plenum design. The present invention comprises a "dry" outer plenum, to which a microwave source is coupled, and two nested "wet" inner plenums. Comprising the two "wet" inner plenums are a bi-planar directional flow water jacket, which provides a continuous flow of hot water for baseboard room heating, and an adjustable sinuous length of heat exchange tubing, which supplies hot tap water on demand.

SUMMARY OF THE INVENTION

It is an object of the present invention to provide a compact, low cost, safe, reliable and efficient apparatus for microwave heating of water to supply both a continuous flow of hot water for baseboard room heating and hot tap water on demand.

Another object of the present invention is to provide a combination microwave water heater and boiler that can be easily incorporated into typical existing plumbing and heating systems without expensive alterations to such systems.

A further object of the present invention is to provide a combination microwave water heater and boiler that can be installed anywhere in a building where there is an electric outlet and a source of pressurized water, without the need for ventilation and chimney connections.

Yet another object of the present invention is to provide a combination microwave water heater and boiler that maximizes efficiency and energy conservation by limiting heat losses and reusing heat that would otherwise be wasted.

Yet a further object of the present invention is to provide a combination microwave water heater and boiler in which the microwave source is coupled to a "dry" outer plenum, so that the microwave source is protected from contact with water/steam without the need for a translucent window and its attendant leakage risks.

Still another object of the present invention is to provide a combination microwave water heater and boiler in which the "dry" outer plenum encloses two nested "wet" inner plenums, comprising a bi-planar directional flow water jacket, which provides a continuous flow of hot water for baseboard room heating, and an adjustable sinuous length of heat exchange tubing, which supplies hot tap water on demand.

Still a further object of the present invention is to provide a combination microwave water heater and boiler in which uniform heating of the water is achieved by continuously pumping heated water through the bi-planar directional flow water jacket, which is internally divided by vertical partitions into multiple jacket frames, which jacket frames are connected through inter-frame corridors by alternating high and low frame ports, such that within each jacket frame a circuitous flow path is defined by alternating upward-projecting and down-ward-projecting flow guides, thereby causing the heated water to circulate alternately in horizontal and vertical planes.

Still yet another object of the present invention is to provide a combination microwave water heater and boiler in which the volume of hot water available for baseboard room heating purposes is expandable by adding more jacket frames to the bi-planar directional flow water jacket, such that boiler capacity can be increased to heat additional rooms without replacing the boiler itself.

Still yet a further object of the present invention is to provide a combination microwave water heater and boiler in which uniform heating of hot tap water is achieved by extending a length of heat exchange tubing in a sinuous path through one or more of the inter-frame corridors, such that the tubing and the water within it absorb heat from the heated water flowing in the two jacket frames that surround each of the inter-frame corridors on either side.

Even yet another object of the present invention is to provide a combination microwave water heater and boiler in which the volume of available hot tap water is expandable by increasing the length of the heat exchange tubing and extending that increased length through unoccupied inter-frame corridors, thereby expanding the effective capacity of the hot water heater without replacing the water heater itself.

These and other useful objects are attained by the unique design of the present invention. A boiler cabinet is divided into two interior compartments. In a magnetron compartment are located one or more microwave magnetrons and associated electrical circuitry, as well as one or more microwave guide horns and a water pump. The magnetrons are coupled to a heating compartment through the wave guide horns, which direct microwaves from the magnetrons into the heating compartment. The heating compartment has an interior wall consisting of a microwave-reflecting material, such a metal. Surrounding the interior wall of the heating compartment is a Faraday cage to prevent leakage of microwaves, and surrounding the Faraday cage is a layer of thermal insulation to prevent heat loss from the heating compartment.

In the heating compartment is located a bi-planar directional flow water jacket, which is a freestanding elongated rectangular structure fabricated of a rigid, durable, watertight, microwave-transparent dielectric material, such as plastic. The bi-planar directional flow water jacket has, at or near either end of its longitudinal axis, an entry side and an exit side. The bi-planar directional flow water jacket has, at or near either end of its transverse axis, a front face and a back face. At the front face entry side is located an external water entry port, through which enters, by way of a zone valve, water returning from a baseboard room heating system. At the back face exit side is located an external water exit port, from which heated water flows out to the baseboard room heating system. The outward flow of heated water to the baseboard room heating system is controlled by one or more thermostats, which open the zone valve and activate a circulator pump.

The bi-planar directional flow water jacket is internally divided into multiple rectangular jacket frames, each having two longitudinal faces, two transverse faces, a bottom face and a top face. Each jacket frame is a totally enclosed plenum but for two openings: a high frame port, located on one of the longitudinal faces near one of the transverse faces and near the top face of the jacket frame, and a low frame port, located on the opposite longitudinal face near the opposite transverse face and near the bottom face of the jacket frame. The jacket frames are separated from one another by narrow inter-frame corridors, through each of which passes a high frame port and a low frame port connecting adjacent jacket frames.

Within each jacket frame a circuitous flow path is defined by alternating upward-projecting and downward-projecting flow guides. An upward-projecting flow guide is a rectangular baffle extending across the transverse width of the jacket frame and projecting upward from the bottom face of the jacket frame to a point below the top face of the jacket frame, such that an open passage remains for water to flow around the baffle below the top face of the jacket frame. A downward-projecting flow guide is a rectangular baffle extending across the transverse width of the jacket frame and projecting downward from the top face of the jacket frame to a point above the bottom face of the jacket frame, such that an open passage remains for water to flow around the baffle above the bottom face of the jacket frame.

A bi-planar counter-flow of water through adjoining jacket frames is established as described in the following example. For purposes of orientation, the "forward face" of each jacket frame is the longitudinal face oriented toward the front face of the bi-planar directional flow water jacket, while the "rear face" of each jacket frame is the longitudinal face oriented toward the back face of the bi-planar directional flow water jacket. Similarly, the "front side" of each jacket frame is the transverse face oriented toward the entry side of the bi-planar directional flow water jacket, while the "back side" of each jacket frame is the transverse face oriented toward the exit side of the bi-planar directional flow water jacket. Accordingly, a flow direction from "front-to-back" is from the front side to the back side of the jacket frame, while flow from "back-to-front" is from the back side to the front side of the jacket frame. An "upward" or "bottom-to-top" flow direction is toward the top face of the jacket frame, while a "downward" or "top-to-bottom" flow is toward the bottom face of the jacket frame.

Water enters the forward face front side of Jacket Frame A through the external water entry port and its flow is directed alternately upward, by an upward-projecting flow guide, then downward, by a downward-projecting flow guide, then upward again, by an upward-projecting flow guide, and so on alternately until the water exits from the rear face back side of Jacket Frame A by way of the high frame port. The water passes by way of the high frame port through the inter-frame corridor and enters the forward face back side of Jacket Frame B at the opening of the high frame port. The water then follows through Jacket Frame B in the reverse path of the flow in Jacket Frame A. Whereas in Jacket Frame A the flow is from front-to-back and upward-downward-upward-etc., the flow in Jacket Frame B is from back-to-front and downward-upward-downward-etc. Hence a counter-flow is established between the adjoining jacket frames, with the water in Jacket Frame B flowing from back-to-front, first downward, then upward, then downward again, and so on alternately until the water exits through the low frame port to flow onward to Jacket Frame C, where the vertical and horizontal flow directions are again reversed.

The bi-planar counter-flow of water through alternating jacket frames is maintained by the pressure generated by the action of a circulator pump associated with the baseboard room heating system. When room temperature drops below a preset level, the room thermostat for that zone of the heating system will signal the zone valve to open and the circulator pump to turn on. The opening of the zone valve will allow returning baseboard hot water to flow into the bi-planar directional flow water jacket through the external water entry port, while the circulator pump draws water out of the bi-planar directional flow water jacket through the external water exit port. This, in turn, creates a pressure gradient that draws water from the front face to the back face of the bi-planar directional flow water jacket. This pressure gradient draws unheated water returning from the baseboard heating system through the external water entry port and into the bi-planar direction flow water jacket.

When the room temperature has reached its preset level, the room thermostat will signal the zone valve to close, and the circulator pump will cease to draw water out of the bi-planar direction flow water jacket. A feed line valve will now open, and the water pump will now turn on and draw water out of the bi-planar directional flow water jacket through the external water entry port and into a pump feed line. The water pump pumps a portion of the incoming water directly through the pump return line back into the bi-planar directional flow water jacket through the external water exit port. The water pump will circulate the rest of the water through one or more water recirculation lines around the magnetrons. This recirculated water absorbs waste heat from the magnetrons, then flows into the pump return line back into the bi-planar directional flow water jacket through the external water exit port. Consequently, when the zone valve is closed and the circulator pump is off, the water pump will maintain a circuitous circulation of water through the bi-planar directional flow water jacket from the back face to the front face. This circuitous circulation ensures that the water on the bi-planar directional flow water jacket will receive even heating from the magnetrons and will not settle into temperature-stratified layers.

When the room temperature again drops below its preset level, the room thermostat will again signal the zone valve to open and the circulator pump to turn on. The water pump will now automatically turn off and the feed line valve will close. In this mode, the pressure gradient generated by the circulator pump will reverse the direction of circuitous water circulation through the bi-planar directional flow water jacket such that the water will now flow from the front face to the back face.

An aquastat of the type typically found in baseboard heating systems is inserted into one or more of the jacket frames and maintains a preset temperature in the bi-planar direction flow water jacket by turning the magnetrons on whenever the water temperature in the jacket frames drops below that preset level.

The volume of heated water circulating in the bi-planar directional flow water jacket can be increased or decreased by adding or removing jacket frames. Thus, the capacity of the boiler portion of the combination microwave boiler/water heater can be increased or decreased to correspond to the number and/or size of the rooms to be heated. If, for example, a home is expanded or if a heating system is extended into a finished basement, the heating capacity of the existing microwave boiler/water heater unit can be expanded without replacing the entire unit.

A length of heat exchange tubing, fabricated of a flexible dielectric material, such as PEX, is extended sinuously through one or more of the inter-frame corridors in the bi-planar directional flow water jacket. The water in the heat exchange tubing is heated both by direct exposure to microwaves and by conduction of heat from the counter-flow of heated water in the adjoining jacket frames. Cold tap water enters the boiler cabinet through a tap water inlet and flows through the heat exchange tubing to the hot water outlet for use when a hot water faucet is opened.

The volume of hot tap water available from the water heater portion of this invention will be determined by the length of heat exchange tubing that is used. Therefore, if there is a need for more hot water—for example, to accommodate a Jacuzzi—the capacity of an existing microwave water heater can be expanded by inserting a longer length of heat exchange tubing and extending that additional length sinuously through the previously unoccupied inter-frame corridors in the bi-planar directional flow water jacket. Accordingly, the effective capacity of the hot water heater portion of the invention can be readily expanded without replacing the combination boiler/water heater itself.

DETAILED DESCRIPTION OF THE PREFERRED EMBODIMENT

The preferred embodiment of the present invention is a combination microwave boiler and hot water heater designed to be usable in connection with an existing baseboard room heating system and an existing plumbing system. This invention features a triple plenum configuration comprising: (1) a primary outer plenum, being a dry plenum to which one or more microwave magnetrons are coupled through one or more wave guide horns, (2) inserted within the primary outer plenum, a secondary inner plenum, being a tank-like wet plenum through which boiler water circulates in bi-planar circuitous cross-flow pattern, as more particularly described below, and (3) extending sinuously within the cross-flow of the secondary inner plenum, a tertiary inner plenum, being a tubular wet plenum that through which tap water circulates.

Figure 1:
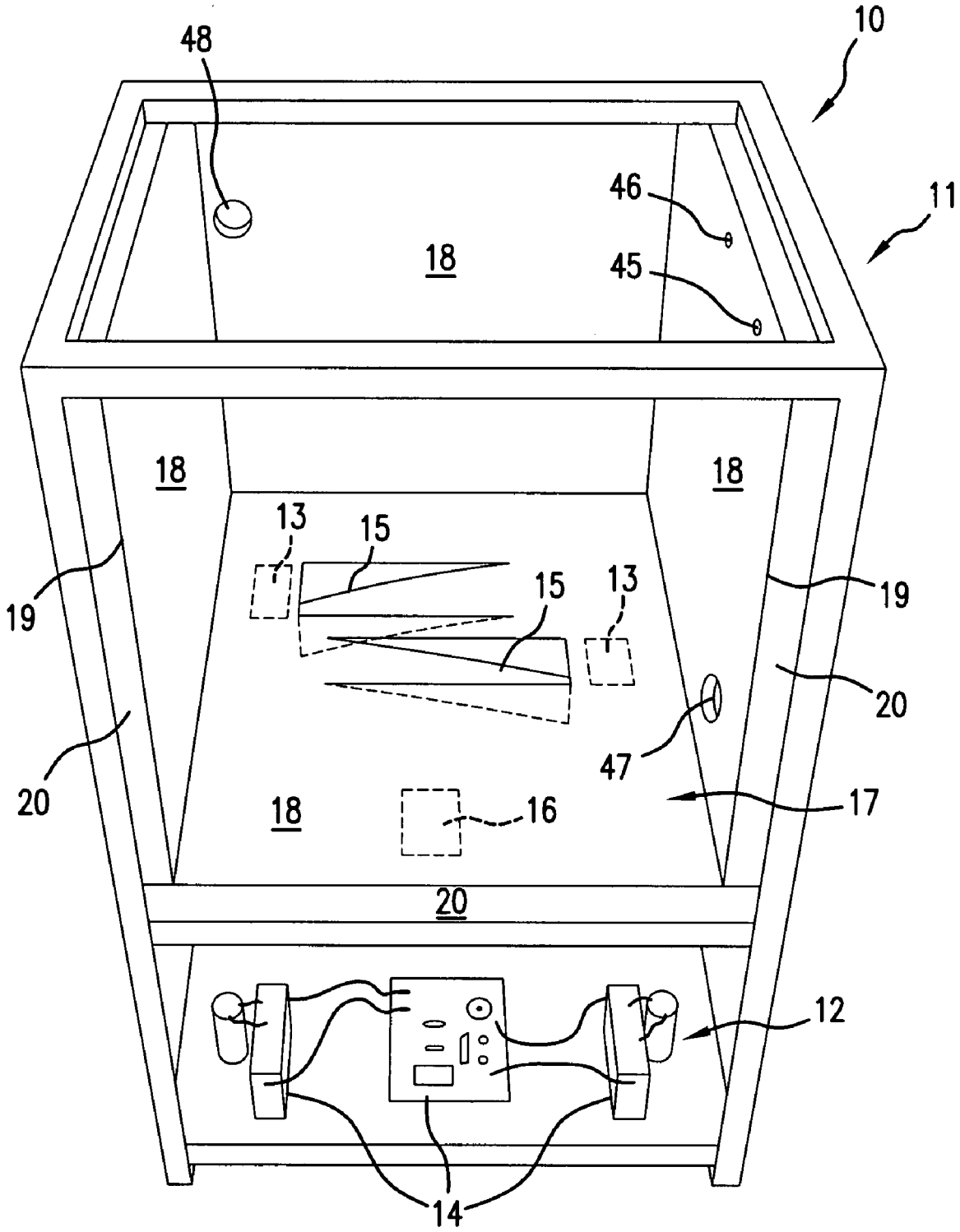
FIG. 1 is a perspective view of the boiler cabinet showing the magnetron compartment and the boiler compartment in accordance with the preferred embodiment of the present invention.

As illustrated in FIG. 1, a boiler cabinet 11 is divided into two interior compartments. In a magnetron compartment 12 are located one or more microwave magnetrons 13 and associated electrical circuitry 14, as well as one or more microwave guide horns 15 and a water pump 16. The magnetrons 13 are coupled to a heating compartment 17 through the wave guide horns 15, which direct microwaves from the magnetrons 13 into the heating compartment 17. The heating compartment 17 has an interior wall 18 consisting of a microwave-reflecting material, such a metal. Surrounding the interior wall 18 of the heating compartment 17 is a Faraday cage 19 to prevent leakage of microwaves, and surrounding the Faraday cage 19 is a layer of thermal insulation 20 to prevent heat loss through the boiler cabinet 11.

Figure 2:
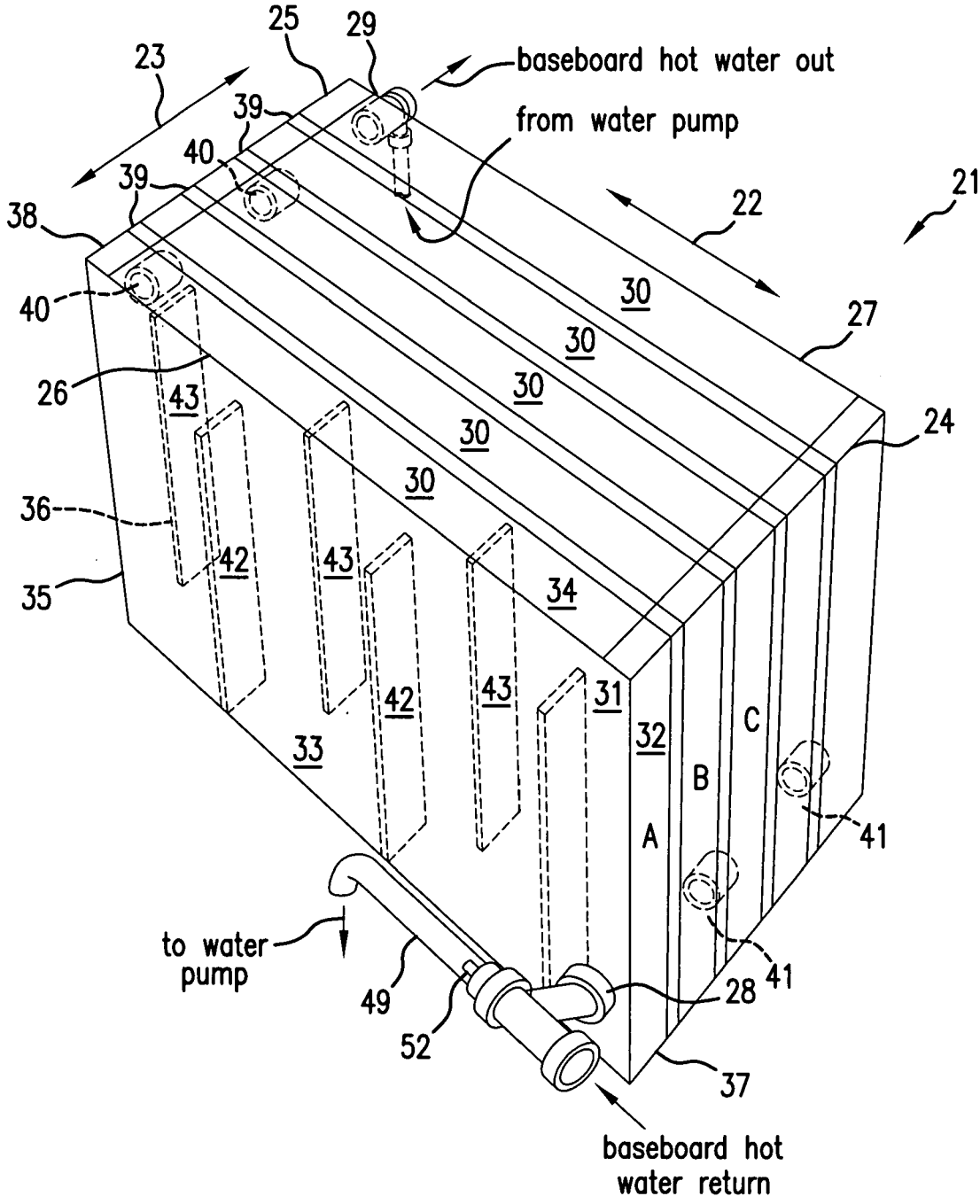
FIG. 2 is a perspective view of the bi-planar directional flow water jacket in accordance with the preferred embodiment.

Within the heating compartment is located a bi-planar directional flow water jacket 21, which is depicted in FIG. 2. The bi-planar directional flow water jacket 21 is a freestanding elongated rectangular structure fabricated of a rigid, durable, water-tight, microwave-transparent dielectric material, such as plastic. The bi-planar directional flow water jacket 21 has a longitudinal axis 22 and a transverse axis 23. At or near either end of its longitudinal axis 22, the bi-planar directional flow water jacket 21 has an entry side 24 and an exit side 25. The bi-planar directional flow water jacket 21 has, at or near either end of its transverse axis 23, a front face 26 and a back face 27. At the front face 26 entry side 24 is located an external water entry port 28, through which enters water returning from a baseboard room heating system (not shown), by way of a boiler water inlet opening 47 in the heating compartment 17, through a zone valve (not shown). At the back face 27 exit side 25 is located an external water exit port 29, from which heated water flows out to the baseboard room heating system (not shown), by way of a boiler water outlet opening 48 in the heating compartment 17. The outward flow of heated water to the baseboard room heating system is thermostatically controlled.

As shown in FIG. 2, the bi-planar directional flow water jacket 21 is internally divided into multiple rectangular jacket frames 30, each of which has two longitudinal faces 31, two transverse faces 32, a bottom face 33, and a top face 34. For purposes of orientation in describing the flow pattern within each jacket frame 30, the longitudinal face 31 oriented toward the front face 26 of the bi-planar directional flow water jacket 21 is designated as a forward face 35 of the jacket frame 30, while the longitudinal face 31 oriented toward the back face 27 of the bi-planar directional flow water jacket 21 is designated as a rear face 36 of the jacket frame 30. Again for flow orientation purposes, the transverse face 32 oriented toward the entry side 24 of the bi-planar directional flow water jacket 21 is designated as a front side 37 of the jacket frame 30, while the transverse face 32 oriented toward the exit side 25 of the bi-planar directional flow water jacket 21 is designated as a back side 38 of the jacket frame 30.

Accordingly, a flow direction from "front-to-back" is from the front side 37 to the back side 38 of the jacket frame, while flow from "back-to-front" is from the back side 38 to the front side 37 of the jacket frame 30. An "upward" or "bottom-to-top" flow direction is toward the top face 34 of the jacket frame 30, while a "downward" or "top-to-bottom" flow is toward the bottom face 33 of the jacket frame 30.

Each jacket frame 30 is a totally enclosed plenum but for two openings: (1) a high frame port 40, located on one of the longitudinal faces 31 near its juncture with one of the transverse faces 32 and near the top face 34 of the jacket frame, and (2) a low frame port 41, located on the opposite longitudinal face 31 near its juncture with the opposite transverse face 32 and near the bottom face 33 of the jacket frame. The jacket frames are separated from one another by narrow inter-frame corridors 39, through each of which passes a high frame port 40 and a low frame port 41 connecting adjacent jacket frames 30.

Within each jacket frame a circuitous flow path is defined by alternating upward-projecting flow guides 42 and downward-projecting flow guides 43. An upward-projecting flow guide 42 is a rectangular baffle extending across the transverse axis 23 width of the jacket frame 30 and projecting upward from the bottom face 33 of the jacket frame 30 to a point below the top face 34 of the jacket frame 30, such that an open passage remains for water to flow around the upward-projecting flow guide 42 below the top face 34 of the jacket frame. A downward-projecting flow guide 43 is a rectangular baffle extending across the transverse axis 23 width of the jacket frame 30 and projecting downward from the top face 34 of the jacket frame to a point above the bottom face 33 of the jacket frame 30, such that an open passage remains for water to flow around the downward-projecting flow guide 43 above the bottom face 33 of the jacket frame 30.

A bi-planar counter-flow of water through adjoining jacket frames is established as described in the following example. Water enters the forward face 35 front side 37 of Jacket Frame A through the external water entry port 28 and its flow is directed alternately upward, by an upward-projecting flow guide 42, then downward, by a downward-projecting flow guide 43, then upward again, by an upward-projecting flow guide 42, and so on, until the water exits from the rear face 36 back side 38 of Jacket Frame A by way of the high frame port 40. The water then passes by way of the high frame port 40 through the inter-frame corridor 39 and enters the forward face 35 back side 38 of Jacket Frame B at the opening of the high frame port 40. The water then follows through Jacket Frame B in the reverse path of the flow in Jacket Frame A. Whereas in Jacket Frame A the flow is from front-to-back and upward-downward-upward, etc., the flow in the Jacket Frame B is from back-to-front and downward-upward-downward, etc. Hence a counter-flow is established between adjoining jacket frames 30. The water in Jacket Frame A flows from back-to-front, first downward, then upward, then downward again, and so on, until the water exits through the low frame port 41 to flow onward to Jacket Frame C, where the vertical and horizontal flow directions are again reversed.

Figure 3:
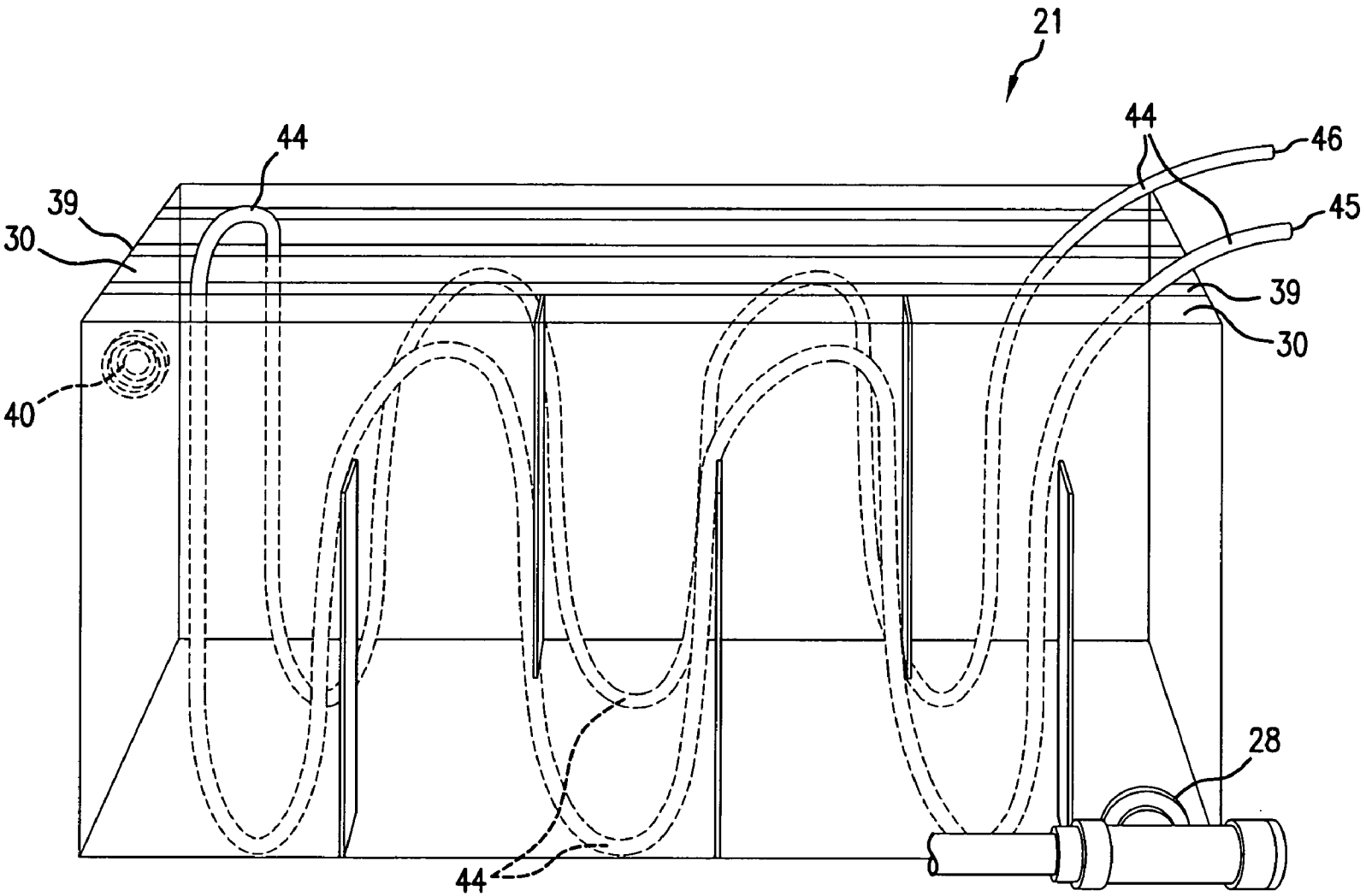
FIG. 3 is a perspective view of the bi-planar directional flow water jacket with the heat exchange tubing inserted in accordance with the preferred embodiment.

The unique design of the bi-planar directional flow water jacket 21 thereby establishes a counter-flow of water through adjoining jacket frames 30 in both the horizontal and vertical planes. This bi-planar counter-flow insures uniform exposure of the water to the microwave energy in the heating compartment 17 and thereby provides even heating of the water. Thus, energy-wasting temperature gradients are avoided. Moreover, the bi-planar counter-flow enables more efficient heat transfer between the boiler water in the jacket frames 30 and the tap water flowing through a length of heat exchange tubing 44 extended sinuously through the inter-frame corridors 39 between the jacket frames 30 (as illustrated in FIG. 3).

The bi-planar counter-flow of water through alternating jacket frames is maintained by the pressure generated by the action of a circulator pump associated with the baseboard room heating system (not shown). When room temperature drops below a preset level, the room thermostat (not shown) for that zone of the heating system will signal the zone valve (not shown) to open and the circulator pump (not shown) to turn on. The opening of the zone valve will allow returning baseboard hot water to flow into the bi-planar directional flow water jacket 21 through the external water entry port 28 while the circulator pump draws water out of the bi-planar directional flow water jacket 21 through the external water exit port 29. This, in turn, creates a pressure gradient that draws water from the front face 26 to the back face 27 of the bi-planar directional flow water jacket 21. This pressure gradient draws unheated water returning from the baseboard heating system through the external water entry port 29 and into the bi-planar directional flow water jacket 21.

Figure 4:
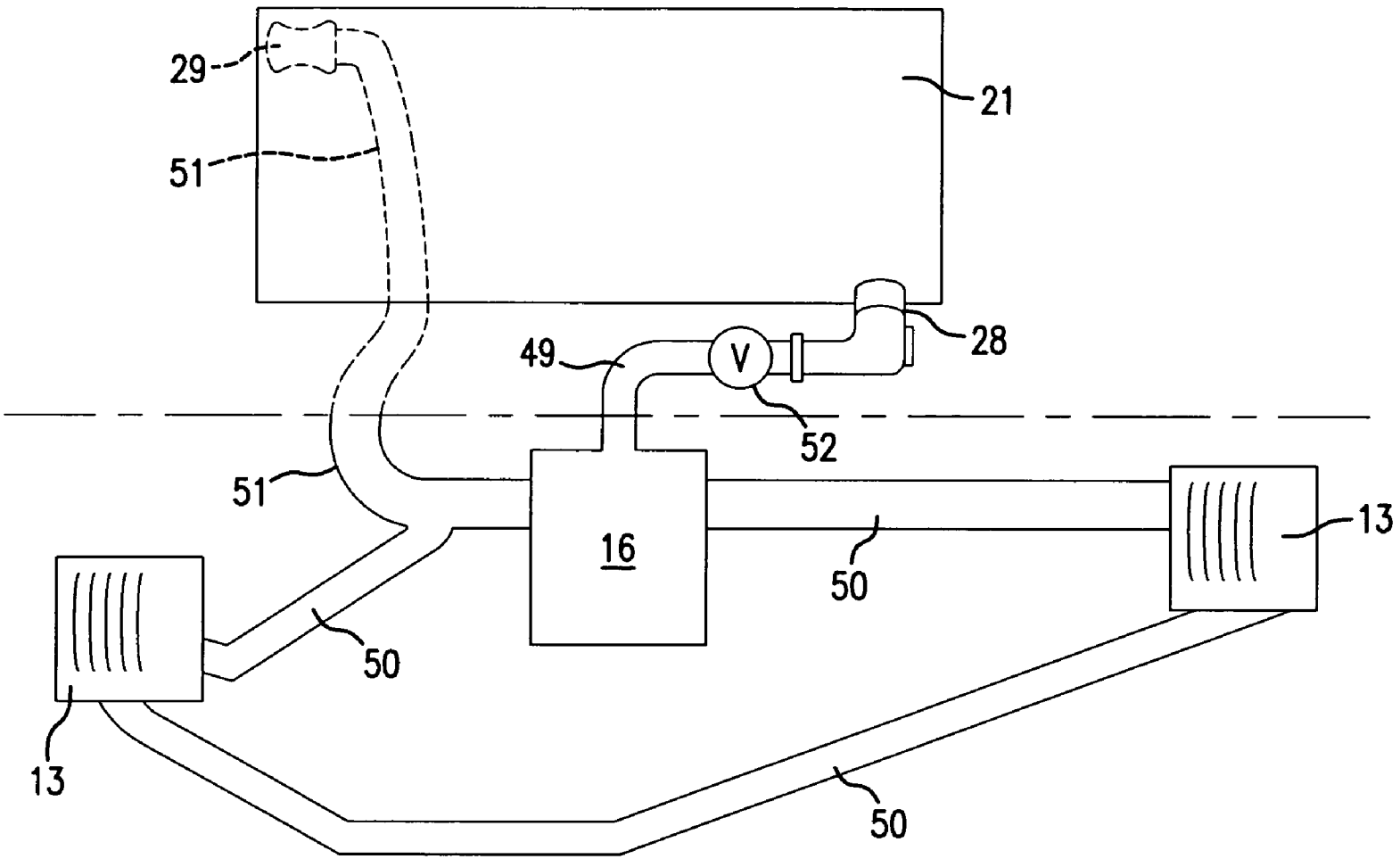
FIG. 4 is a front elevation view of the magnetrons, water pump, water pump feed line, water re-circulation lines, pump return lines and feed line valve in accordance with the preferred embodiment.

When the room temperature has reached its preset level, the room thermostat will signal the zone valve to close, and the circulator pump will cease to draw water out of the bi-planar directional flow water jacket 21. Referring now to FIG. 4, a feed line valve 52 will open, and the water pump 16 will now turn on and draw water out of the bi-planar directional flow port water jacket 21 through the external water entry port 28 and into pump feed line 49. The water pump 16 pumps a portion of the incoming water directly through the pump return line 51 back into the bi-planar directional flow water jacket 21 through the external water exit port 29. The water pump 16 will circulate the remainder of the water through one or more water recirculation lines 50 around the magnetrons 13. The recirculated water absorbs waste heat from the magnetrons 13, then flows into the pump return line 51 back into the bi-planar directional flow water jacket 21 at the external water exit port 29. Consequently, when the zone valve is closed and the circulator pump is off, the water pump will maintain a circuitous circulation of water through the bi-planar directional flow water jacket 21 from the back face 27 to the front face 26. This circuitous circulation ensures that the water in the bi-planar directional flow water jacket 21 will receive even heating from the magnetrons 13 and will not settle into temperature-stratified layers.

When the room temperature again drops below its preset level, the room thermostat will again signal the zone valve to open and the circulator pump to turn on. The water pump 16 will now automatically turn off and the feed line valve 52 will close. In this mode, the pressure gradient generated by the circulator pump will reverse the direction of circuitous water circulation through the bi-planar directional flow water jacket 21 such that the water will now flow from the front face 26 to the back face 27.

An aquastat (not shown) of the type typically found in baseboard heating system is inserted into one or more of the jacket frames 30 and maintains a preset temperature in the bi-planar directional flow water jacket 21 by turning the magnetrons 13 on whenever the water temperature in the jacket frames 30 drops below that preset level.

The volume of heated water circulating in the bi-planar directional flow water jacket 21 can be increased or decreased by adding or removing jacket frames 30. Thus, the capacity of the boiler portion of a combination microwave boiler/water heater 10 can be increased or decreased to correspond to the number and/or size of the rooms to be heated. Consequently, if a home is expanded or if a heating system is extended into a finished basement, the heating capacity of the existing microwave boiler/water heater unit 10 can be expanded without replacing the entire unit.

As depicted in FIG. 3, a length of heat exchange tubing 44, fabricated of a flexible dielectric material, such as PEX, is extended sinuously through one or more of the inter-frame corridors 39 in the bi-planar directional flow water jacket 21. The water in the heat exchange tubing 44 is heated both by direct exposure to microwaves and by conduction of heat from the counter-flow of heated water in the adjoining jacket frames 30. Cold tap water enters the boiler cabinet 11 through a tap water inlet 45 and flows through the heat exchange tubing 44 to the hot water outlet 46 for use when a hot water faucet is opened. The locations of the tap water inlet 45 and hot water outlet 46 with reference to the heating compartment 17 are depicted in FIG. 1.

The volume of hot tap water available from the water heater portion of this invention will be determined by the length of heat exchange tubing 44 that is used. Therefore, if there is a need for more hot water—for example, to accommodate a new Jacuzzi—the capacity of an existing microwave water heater can be expanded by inserting a longer length of heat exchange tubing 44 and extending that additional length sinuously through one or more of the previously unoccupied inter-frame corridors 39 in the bi-planar directional flow water jacket 21. Accordingly, the effective capacity of the hot water heater portion of the invention can be readily expanded without replacing the combination boiler/water heater 10 itself.

It is apparent, therefore, that the unique triple-plenum configuration—comprising the dry heating compartment 17, the bi-planar directional flow jacket 21, and the heat exchange tubing 44—provides a combination boiler and hot-water heater that can be installed in an existing plumbing/heating system without major modifications to the existing system. Moreover, the unique horizontal and vertical counter-flow design of the bi-planar directional flow jacket 21 effectively overcomes problems of uneven water heating and wasteful temperature gradients which have largely marginalized the commercial viability of the prior art microwave boilers/heaters.

While this invention has been described with reference to a specific preferred embodiment, the description is not to be construed in a limiting sense. Various modifications of the disclosed embodiment, as well as other embodiments of the invention, will be apparent to persons skilled in the art upon reference to this description. It is therefore contemplated that the appended claims will cover any such modifications or embodiments that fall within the true scope of this invention.

What is claimed is:

1. A combination boiler and hot water heater comprising:

(a) a boiler cabinet comprising and a magnetron compartment and a heating compartment, such that the magnetron compartment contains one or more microwave magnetrons which are electrically connected to one or more magnetron circuits and electromagnetically coupled with one or more microwave guide horns, which microwave guide horns direct microwaves generated by the magnetrons into the heating compartment;

(b) a bi-planar directional flow water jacket located in the heating compartment, which bi-planar directional flow water jacket is an elongated plenum having a horizontal plane and a vertical plane, and which bi-planar directional flow water jacket has an external water entry port, through which unheated water from a hydronic space heating system enters the bi-planar directional flow water jacket, and an external water exit port, through which water heated by the magnetrons exits from the bi-planar directional flow water jacket to circulate in the hydronic space heating system;

(c) a plurality of jacket frames and interframe corridors comprising the internal structure of the bi-planar directional flow water jacket, wherein adjacent jacket frames are separated by interframe corridors, and adjacent jacket frames are hydraulically interconnected by a plurality of frame ports that passes through the interframe corridors, with each jacket frame being an elongated plenum having a frame port at either end, such that the direction of flow with respect to the horizontal plane of the bi-planar direction flow water jacket is reversed in each successive jacket frame, thereby creating a circuitous cross-flow flow pattern in the horizontal plane of the bi-planar direction flow water jacket;

(d) a plurality of flow guides within each jacket frame, which flow guides are rectangular baffles aligned with the vertical plane of the bi-planar directional flow water jacket, such that the orientation of successive flow guides alternates between upward projecting and downward projecting, thereby directing the water flow through the jacket frame in a circuitous pattern in the vertical plane of the bi-planar direction flow water jacket;

(e) a length of heat exchange tubing extended sinuously through one or more of the interframe corridors in the vertical plane of the bi-planar directional flow water jacket, such that cold tap water enters the heat exchange tubing through a tap water inlet and is heated both by exposure to microwave emitted by the magnetrons and by conduction of heat from heated water in the jacket frames adjoining the interframe corridors on either side, and such that hot tap water exits from the heat exchange tubing through a hot water outlet which is connected through an external plumbing system to one or more hot water faucets; and (f) one or more aquastats inserted within one or more of the jacket frames, which aquastats are electrically connected to the magnetrons and turn the magnetrons on whenever the water temperature in any one of the jacket frames falls below a preset temperature level, and which aquastats turn the magnetrons off whenever the temperature in all of the jacket frames is above the preset temperature level.

2. The combination boiler and hot water heater according to claim 1, wherein the magnetron compartment also contains a water pump which is hydraulically connected on its intake side to the external water entry port of the bi-planar directional flow water jacket through a water pump feed line and a feed line valve, and which water pump is hydraulically connected on its output side to the external water exit port of the bi-planar directional flow water jacket, and which water pump is electrically controlled such that it turns on whenever heated water is not flowing out of the bi-planar directional flow water jacket through the external water exit port, thereby maintaining a bi-planar circuitous water flow through the bi-planar directional flow water jacket to provide uniform heating.

3. The combination boiler and hot water heater according to claim 2, wherein the water pump is hydraulically connected to the magnetrons and circulates some of the water from the water pump feed line around the magnetrons to recover waste heat.

4. The combination boiler and hot water heater according to claim 3, wherein successive frame ports are oppositely oriented along the vertical plane of the bi-planar directional flow water jacket, such that a high frame port alternates with a low frame port, thereby augmenting the circuitous flow pattern in the vertical plane of the bi-planar directional flow water jacket.

5. The combination boiler and hot water heater according to claim 4, wherein the fluid capacity of the bi-planar directional flow water jacket can be increased by adding more jacket frames, thereby allowing the boiler capacity to be expanded without replacing the entire boiler.

6. The combination boiler and hot water heater according to claim 5, wherein the fluid capacity of the heat exchange tubing can be increased by inserting a longer length of the heat exchange tubing into the bi-planar directional flow water jacket and extending the longer heat exchange tubing sinuously through one or more of the previously unoccupied inter-frame corridors of the bi-planar directional flow water jacket, thereby allowing the hot water capacity to be expanded without installing another hot water heater.

* * * * *